US012330833B2

(12) United States Patent
Rouse

(10) Patent No.: US 12,330,833 B2
(45) Date of Patent: Jun. 17, 2025

(54) REFILL RING

(71) Applicant: Joseph Grant Rouse, Fayetteville, AR (US)

(72) Inventor: Joseph Grant Rouse, Fayetteville, AR (US)

( * ) Notice: Subject to any disclaimer, the term of this patent is extended or adjusted under 35 U.S.C. 154(b) by 149 days.

(21) Appl. No.: 18/454,026

(22) Filed: Aug. 22, 2023

(65) Prior Publication Data

US 2024/0067382 A1 Feb. 29, 2024

Related U.S. Application Data

(60) Provisional application No. 63/400,231, filed on Aug. 23, 2022.

(51) Int. Cl.
*B65B 67/12* (2006.01)

(52) U.S. Cl.
CPC ..... *B65B 67/12* (2013.01)

(58) Field of Classification Search
CPC ..... B65B 67/12
See application file for complete search history.

(56) References Cited

U.S. PATENT DOCUMENTS 189,202 A * 4/1877 Eberhard ..... B65B 67/12 248/101
645,199 A * 3/1900 Brooks ..... B65B 67/12 211/85.15
1,414,575 A * 5/1922 McCart ..... B65B 67/12 248/101
2,827,931 A * 3/1958 Melvin ..... F25D 25/005 141/369
3,771,578 A * 11/1973 Huff ..... B65B 67/12 141/340
4,312,447 A * 1/1982 McWilliams ..... B65B 67/12 220/729
4,702,445 A * 10/1987 Ivory ..... B65B 67/12 248/97
4,907,789 A * 3/1990 Tice ..... A47J 47/005 269/302.1

(Continued)

FOREIGN PATENT DOCUMENTS

CH 87676 A * 1/1921 ..... B65B 67/12
CN 109160019 A * 1/2019 ..... B65B 67/12

(Continued)

*Primary Examiner* — Lucas E. A. Palmer
(74) *Attorney, Agent, or Firm* — Wright Lindsey Jennings, LLP; Meredith Lowry

(57) ABSTRACT

An apparatus and method for refilling a chalk containment pouch, also called a chalk ball/sock/sphere with a quantity of chalk. The apparatus includes a refill ring formed as a cylindrical body defining an interior passage extending between a top opening and a bottom opening. An annular groove is defined about a top end of the cylindrical body is dimensioned to receive a closure element surrounding the opening of the chalk containment pouch to secure the pouch with the refill ring. In a method of refilling the chalk containment pouch the refill ring provides a rigid or semi-rigid structure to allow the user to manipulate the pouch and to retain the opening of the chalk containment pouch in an open condition. The refill ring provides for a dispensing into, as well as a scooping and a packing of chalk within the chalk containment pouch.

7 Claims, 6 Drawing Sheets

(56) References Cited

U.S. PATENT DOCUMENTS

| | | | | | |
|---|---|---|---|---|---|
| 5,397,085 | A * | 3/1995 | Spagnolo | B65B 67/12 | 248/101 |
| 5,915,768 | A * | 6/1999 | Young | B65B 67/12 | 15/257.1 |
| 6,241,428 | B1 * | 6/2001 | Stober | B41F 23/06 | 406/146 |
| 2010/0096398 | A1 * | 4/2010 | Gorskey | B65D 47/06 | 220/793 |
| 2010/0180552 | A1 * | 7/2010 | Katada | B65B 57/10 | 53/469 |
| 2013/0178793 | A1 * | 7/2013 | Matias | A61M 1/062 | 604/74 |
| 2022/0306329 | A1 * | 9/2022 | McPheat | B65B 39/02 | |
| 2024/0002089 | A1 * | 1/2024 | Jones | B65B 43/54 | |

FOREIGN PATENT DOCUMENTS

| | | | | | |
|---|---|---|---|---|---|
| FR | 2353249 | A * | 2/1978 | B65B 67/12 | |
| FR | 2640943 | A * | 6/1990 | B65B 67/12 | |
| GB | 1374903 | A * | 11/1974 | B65B 67/12 | |

* cited by examiner

REFILL RING

CROSS-REFERENCE TO RELATED APPLICATION

This application claims the benefit of priority of U.S. provisional application No. 63/400,231, filed Aug. 23, 2022, the contents of which are herein incorporated by reference.

BACKGROUND OF THE INVENTION

The present invention relates to gripping chalk comprised primarily of magnesium carbonate and, more particularly, to refilling a gripping chalk containment pouch, also called a chalk ball/sock/sphere.

Climbers, ninjas, gymnasts, and other athletes frequently apply a chalk material to their hands to improve their grip or prevent hands from getting sweaty. For some competition venues, the chalk may be contained in a bowl or a tray, where the athlete may apply the chalk just prior to an event. In other instances, where the athlete desires to carry chalk on their person for immediate access, the chalk is typically contained in a porous containment pouch.

The porous containment pouch that climbers, ninjas and other athletes use will deplete and the "bags" will need to be refilled or discarded. Refilling the containment pouch by pouring the chalk into the containment pouch is difficult because of the elastic material and the opening of the containment pouch has a tendency to retract closed, which hinders refilling, requiring more hands to help stabilize and hold open. Consequently, refilling often results in spilling chalk.

Traditional funnels are not conducive to scooping an adequate amount of chalk and conveying it into the containment pouch. A traditional funnel has a very wide cone for pouring into. It also has a very slender tapered neck for inserting into a bottle/jar/container. Three problems with trying to refill a chalk ball/sock/sphere with a traditional wide cone/long tapered neck funnel are 1) the tapered neck clogs with chalk, 2) you can't easily scoop chalk with a wide cone funnel from inside a larger chalk bag/bucket into the chalk ball/sock/sphere to refill it, and 3) the narrow tapered neck fits too loosely in the opening of the chalk ball/sock/sphere, which can move around or slip out making refilling the chalk ball/sock/sphere more difficult.

As can be seen, there is a need for an improved apparatus and method for refilling a chalk containment pouch.

SUMMARY OF THE INVENTION

In one aspect of the present invention, an apparatus for refilling a chalk containment pouch is disclosed. The apparatus includes a cylindrical body having a top portion, a bottom portion, an outer sidewall, and an interior sidewall defining an interior passage extending between a top opening and a bottom opening of the cylindrical body. An annular groove is defined in the outer sidewall about the top end of the cylindrical body. The bottom portion of the cylindrical body is defined by an inwardly converging frustoconical element.

In some embodiments, the inwardly converging frustoconical element is defined by the outer sidewall. A bottom end of the inwardly converging frustoconical element has an outer diameter dimensioned to be received and facilitate insertion of the bottom end within an opening of the chalk containment pouch. An upper end of the inwardly converging frustoconical segment has an outer diameter dimensioned to be received in the opening of the chalk containment pouch.

In some embodiments, an annular rim is defined about the top portion above the annular groove. The annular groove may be defined as a circular section, with the annular groove dimensioned to receive a closure element surrounding the opening of the chalk containment pouch. The closure element is operable between an open position and a partially closed position. A cinching of the closure element retains the opening of the chalk containment pouch with the apparatus.

In other aspects of the invention, a method of refilling a chalk containment pouch with a quantity of chalk is disclosed. The method includes inserting a frustoconical element defining a bottom portion of a cylindrical body into an opening of the chalk containment pouch. A closure element surrounding the opening of the chalk containment pouch is positioned within an annular groove defined in an outer sidewall around the top end of the cylindrical body. The closure element is then cinched about the annular groove.

In some embodiments, the method includes dispensing a quantity of the chalk into a top opening of the cylindrical body, such that the quantity of chalk is carried through an interior passage of the cylindrical body and delivered into the chalk containment pouch. The dispensing may include scooping the cylindrical body in the quantity of chalk. The dispensing may also include packing the quantity of chalk by a digital manipulation of the chalk contained within the cylindrical body.

In some embodiments, the method also includes releasing the closure element from the annular groove and retracting the frustoconical element of the cylindrical body from the opening. The method may also include operating the closure element to close the opening of the chalk containment pouch.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improved apparatus and method for refilling chalk in a chalk containment pouch. A scooping funnel ring according to aspects of the invention fits neatly into the opening of a chalk containment pouch and is secured with the chalk ball/sock/sphere's elastic cord or drawstring, fitting snuggly in an arcuate groove defined in a throat of the funnel ring. The containment pouch is now equipped with a scoop that allows the user to funnel chalk into the opening with a single hand and can be easily packed full with simple pressure from your thumb! This makes refilling possible even with just one hand, since the same thumb on the hand holding the chalk ball/sock/sphere equipped with our scooping funnel ring/oval is used to pack in more chalk into the chalk ball/sock/sphere.

Figure 1:
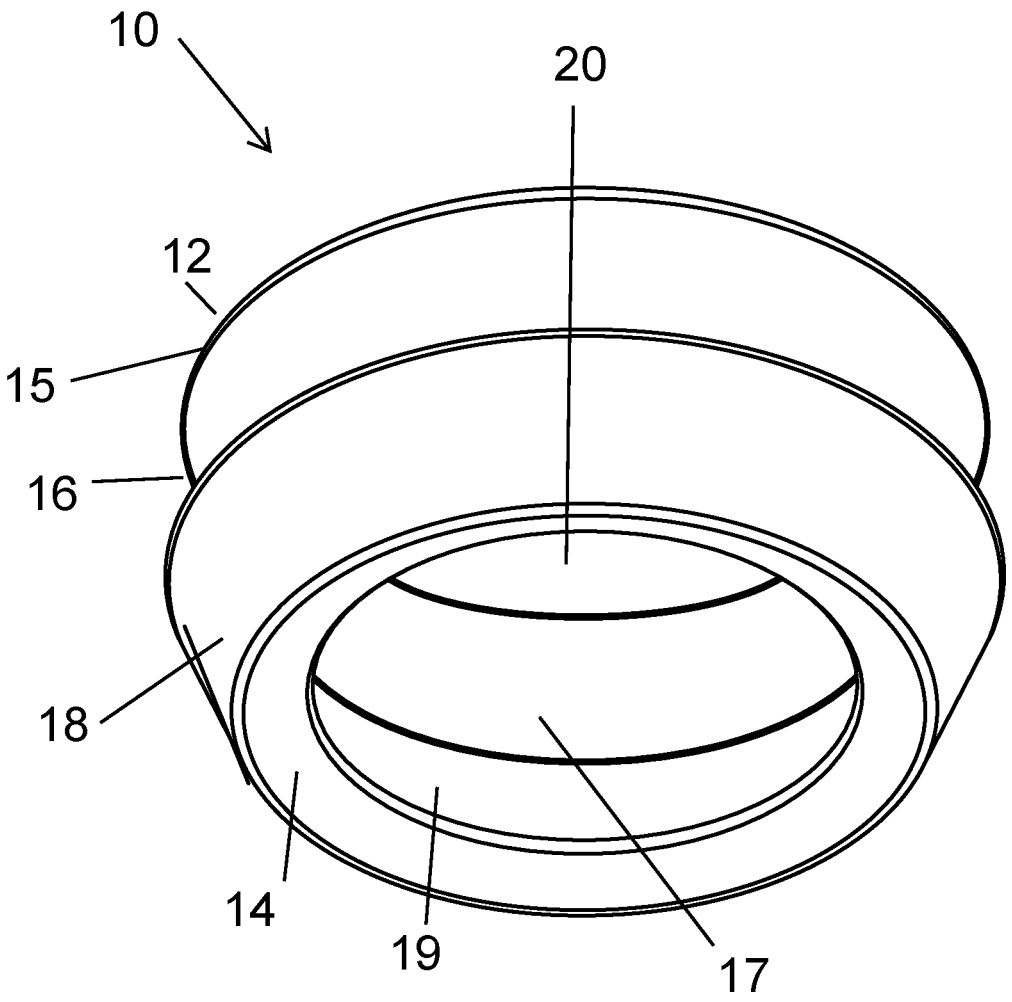
FIG. 1 is a bottom perspective view of a refill ring for the purpose of refilling chalk in a chalk containment pouch, also called a chalk ball/sock/sphere.
Figure 2:
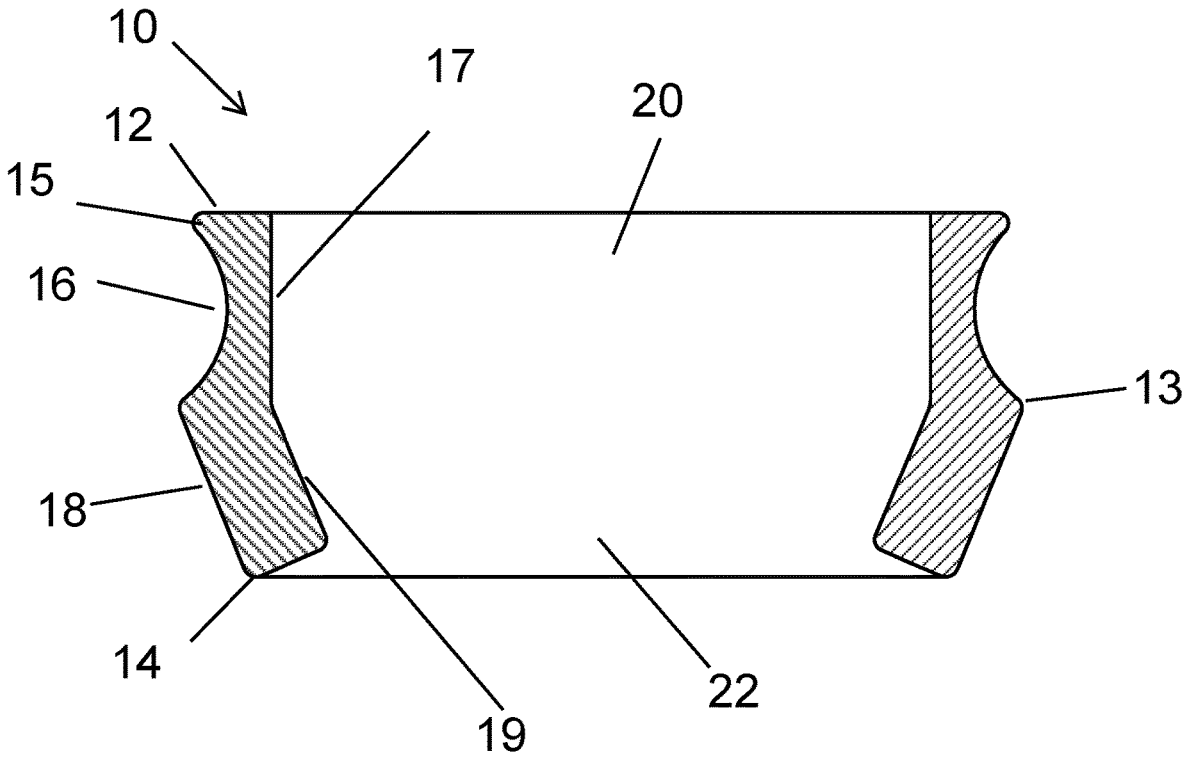
FIG. 2 is a cross sectional view of the refill ring.
Figure 3:
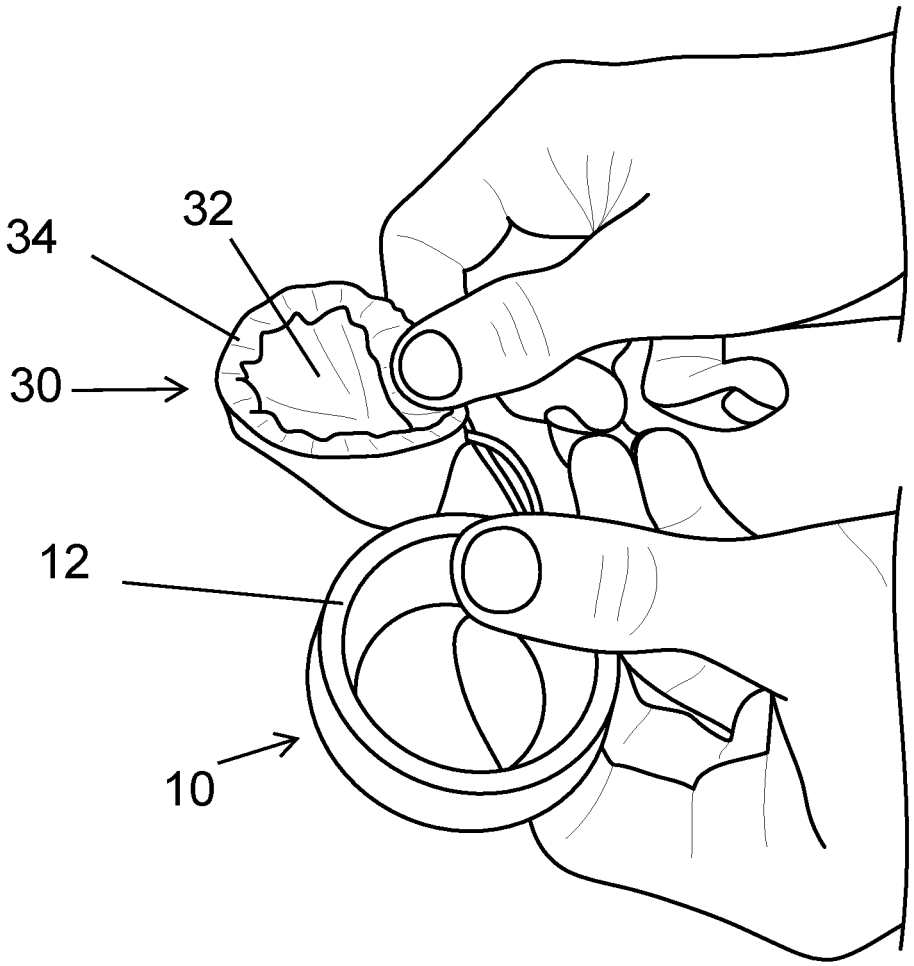
FIG. 3 is an illustration of a first step of a method of installing the refill ring into a chalk containment pouch to refill chalk.
Figure 4:
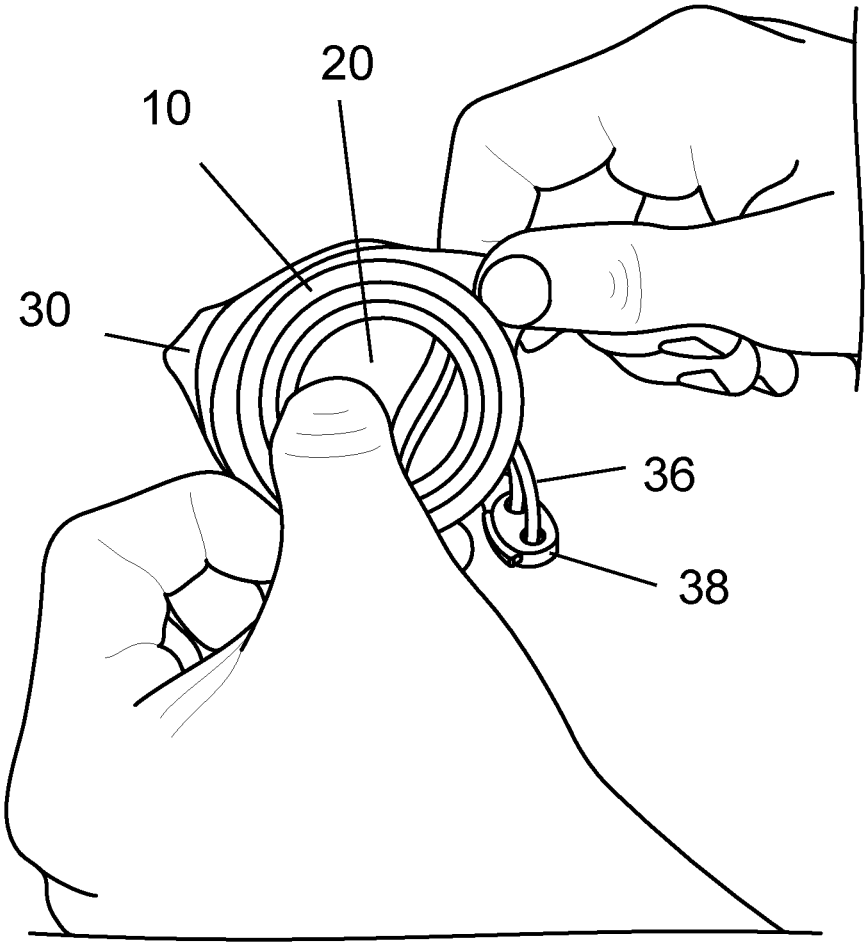
FIG. 4 is a second step of the method of installing the refill ring into a chalk containment pouch to refill chalk.
Figure 5:
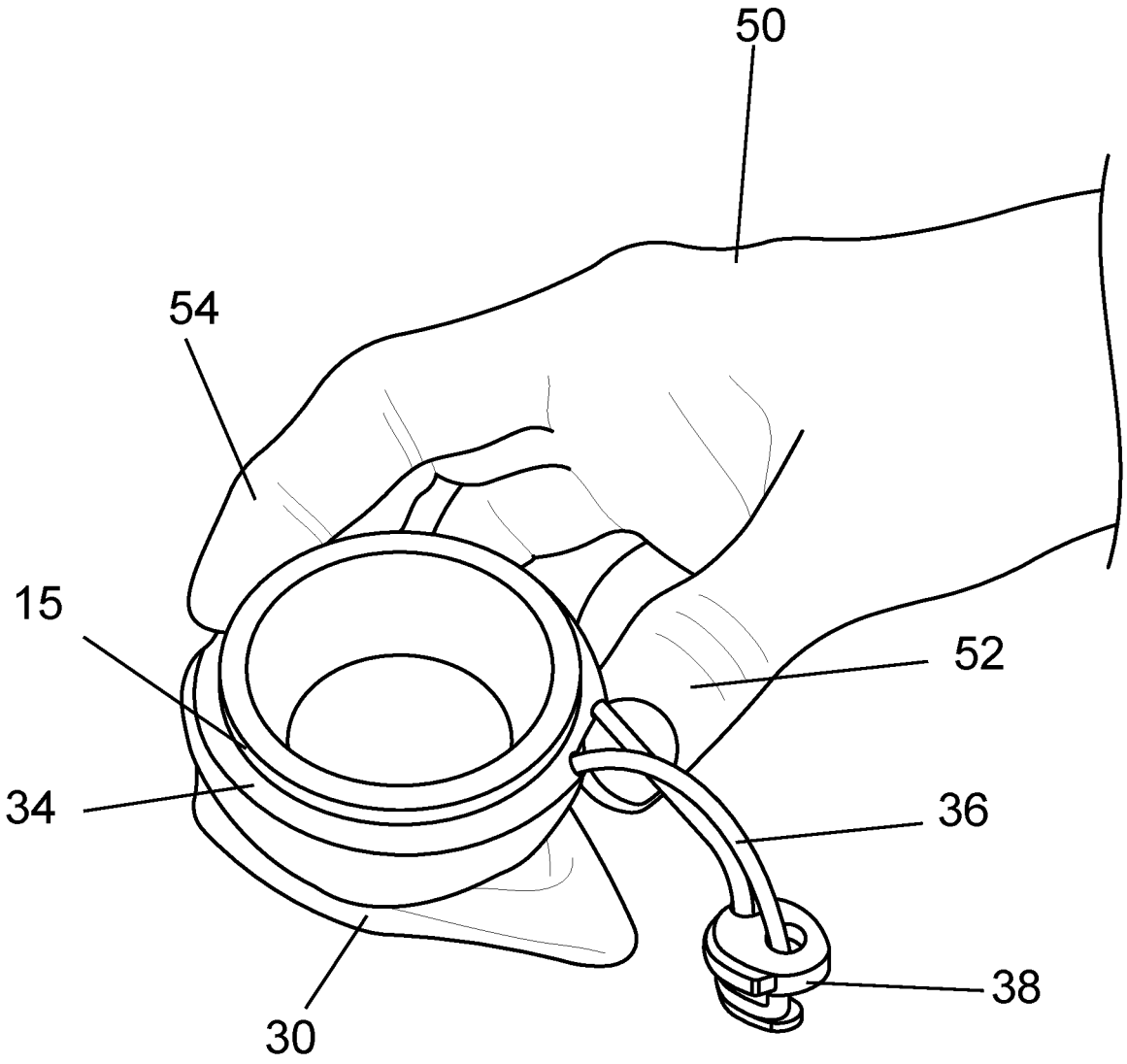
FIG. 5 is an illustration of a third step in the method of installing the refill ring into the chalk containment pouch to refill chalk and illustrating a method of holding the installed refill ring and containment pouch together for use.
Figure 6:
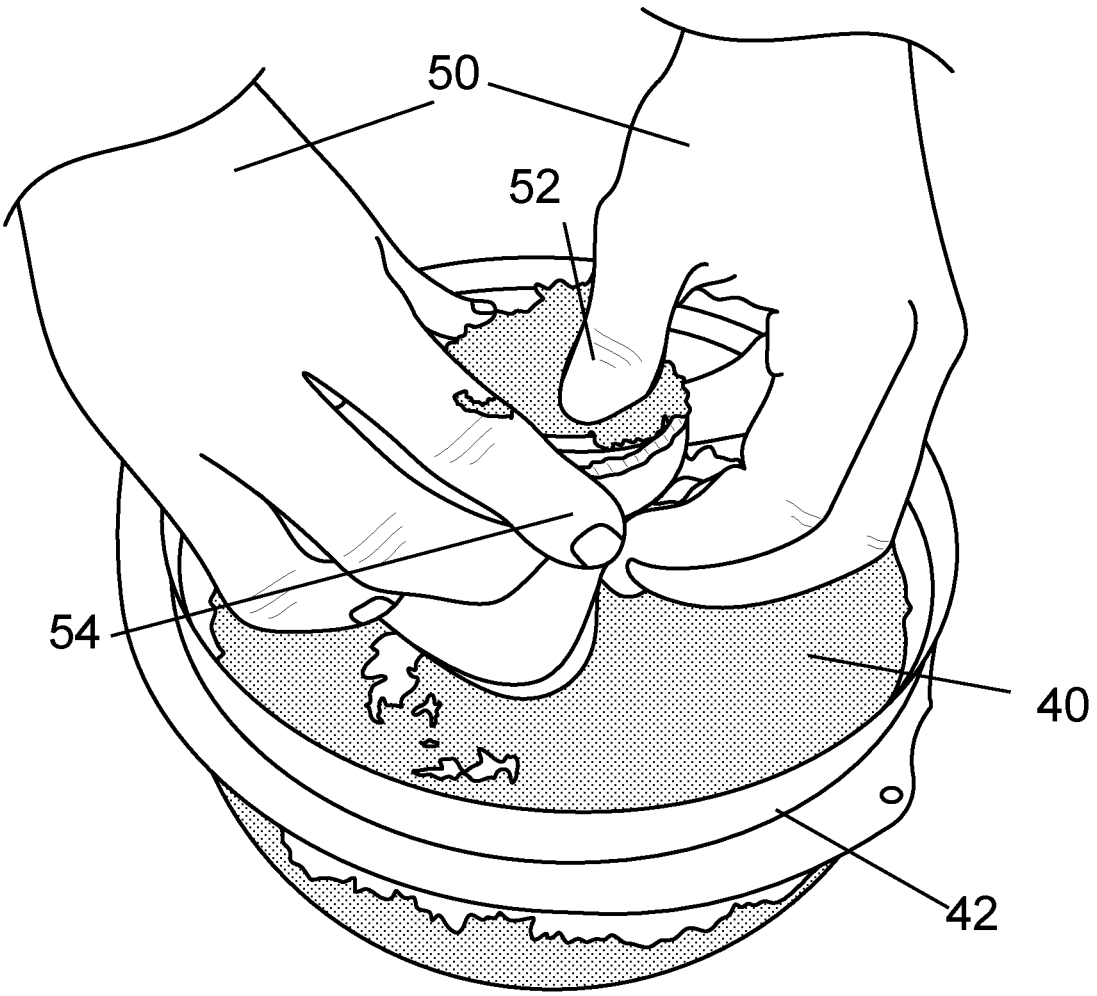
FIG. 6 is an illustration of a method of installing the refill ring into the chalk containment pouch.

As seen in reference to the drawings of FIGS. 1-6, an apparatus, called a refill ring 10, for refilling a chalk containment pouch 30 is disclosed. Refill ring 10 includes a cylindrical body having a top portion 12, a bottom portion 14, an outer sidewall 13 and an interior sidewall 17, 19 defining an interior passage extending between a top opening 20 and a bottom opening 22 of the cylindrical body 10. An annular groove 16 is defined in the outer sidewall 13 about the top end 12 of the cylindrical body 10.

The bottom portion 14 of the cylindrical body defined by an inwardly converging frustoconical element 18. The inwardly converging frustoconical element 18 is defined by the outer sidewall 13. The bottom end of the inwardly converging frustoconical element 18 has an outer diameter that is dimensioned to be received and facilitate insertion of the bottom end 14 within an opening 32 of the chalk containment pouch 30. An upper end of the inwardly converging frustoconical segment 18 has an outer diameter that is dimensioned to be received in the opening 32 of the chalk containment pouch 30.

The refill ring 10 may also have an annular rim 15 defined about the top portion 12 above the annular groove 16. The annular rim 15 facilitates positioning of a closure element 34 surrounding the opening 32 of the chalk containment pouch 30 within the annular groove 16. The annular rim 15 also provides a rest for a user's thumb 52 or finger 54 when handling the refill ring 10 and the chalk containment pouch 30, as well as a packing of the chalk 40 within the chalk containment pouch 30 when refilling the chalk containment pouch 30 with a quantity of chalk 40.

Preferably the annular groove 16 is defined as a circular section, where the annular groove 16 dimensioned to receive the closure element 34 surrounding the opening 32 of the chalk containment pouch 30. closure element 34 is operable between an open position and a partially closed position. In some instances, the closure element 34 may be an elastic contained within a sleeve surrounding the opening 32. In other instances, the closure element 34 may include a drawstring 36. The drawstring 36 may be made of an elastic material. The drawstring 36 may also have a toggle type retainer 38 to retain the drawstring 36 in a cinched condition within the annular groove 16. A cinching of the closure element 34 retains the opening 32 of the chalk containment pouch 30 with the refill ring 10.

The frustoconical segment 18 may have an inwardly converging sidewalls on at least an outer sidewall 13 of the refill ring 10 to facilitate insertion of the frustoconical segment 18 in the opening 32 of the chalk containment pouch 30. The frustoconical segment 18 may also include an inwardly converging interior sidewall 19 providing for a funneling of the chalk 40 during delivery through the internal passage of the refill ring 10.

The refill ring 10 may be formed from a rigid or semi-rigid material that is suitable for maintaining the opening 32 of the chalk containment pouch 30 in an open condition to receive chalk 40 through the interior passage of the refill ring 10. The refill ring 10 may be injection molded, such as with a thermoplastic material or an elastomeric material. Likewise, the refill ring 10 may also be fabricated via 3D printing and other additive manufacturing techniques.

In a non-limiting embodiment, the refill ring 10 may have an outer diameter of the frustoconical element 18 of about 2¼ inches. An inner diameter of the top opening 20 of about 1.75 inches. An outer diameter of the annular lip 15 that is less than that of the frustoconical element 18 of about 2⅛ inches. A height of the top portion of about ½ inch. The annular groove 16 may have a radius of 0.30 inches. The frustoconical element 18 may converge inwardly at an angle of about 158 degrees, with a length of about ½ inch.

Other aspects of the invention include a method of refilling a chalk containment pouch 30 with a quantity of chalk 40. As seen in reference to FIGS. 3-6, the method includes inserting the frustoconical element 18 defining a bottom portion of the refill ring 10 into the opening 32 of the chalk containment pouch 30. A closure element 34 surrounding the opening 32 of the chalk containment pouch 30 is positioned within the annular groove 16 defined in the outer at the top end of the refill ring 10. Once positioned within the annular groove 16, the closure element 34 is cinched about the annular groove 16 such that the refill ring 10 is retained in connection with the chalk containment pouch 30.

Once connected, a quantity of the chalk 40 is dispensed into the top opening 20 of the refill ring 10, such that the quantity of chalk 40 is carried through the interior passage of the refill ring 10 and delivered into the chalk containment pouch 30. As best seen in reference to FIG. 6, the refill ring 10 provides a user the ability to easily deliver the quantity of chalk 40 into the chalk containment pouch 30. The refill ring 10 provides a rigid to semi rigid structure that retains the opening of the chalk containment pouch 30 in an open condition. The refill ring 10 also provides the user a structure for manipulating the chalk containment pouch 30 for the delivery of the chalk 40.

For example, the user may grasp the refill ring 10 and chalk containment pouch 30 and utilize the refill ring 10 to scoop a quantity of chalk 40 contained within a bowl 42 and deliver the chalk 40 into the chalk containment pouch 30. Advantageously, the refill ring 10 provides the user the ability to pack the chalk containment pouch 30 with a desired quantity of the chalk 40. By grasping the refill ring 10 in the user's fingers 54 and thumb 52 of the user's hand 50, the user may utilize their thumb 52 to pack an additional quantity of chalk 40 through the interior passage into the chalk containment pouch 30.

Once a desired quantity of chalk 40 has been dispensed into the chalk containment pouch 30, the closure element 34 is released from the annular groove 16. The frustoconical element 18 of the refill ring is retracted from the opening 32 of the chalk containment pouch 30. Once retracted, the closure element 34 is operated to close the opening 32 of the chalk containment pouch 30 by pulling of the drawstring 36 and cinching the toggle type retainer 38 to keep the chalk 40 inside the chalk containment pouch 30. The user may then use the chalk containment pouch 30 to dispense chalk for their desired activity.

It should be understood, of course, that the foregoing relates to exemplary embodiments of the invention and that modifications may be made without departing from the spirit and scope of the invention as set forth in the following claims.

I claim:

1. An apparatus for refiling a chalk containment pouch, comprising:

a cylindrical body having a top portion, a bottom portion, an outer sidewall, and an interior sidewall defining an interior passage extending between a top opening and a bottom opening of the cylindrical body;

an annular grove defined in the outer sidewall about the top portion of the cylindrical body; and the bottom portion of the cylindrical body defined by an inwardly converging frustoconical element.

2. The apparatus of claim 1, wherein the inwardly converging frustoconical element is defined by the outer sidewall.

3. The apparatus of claim 2, wherein a bottom end of the inwardly converging frustoconical element has an outer diameter dimensioned to be received and facilitate insertion of the bottom end within an opening of the chalk containment pouch.

4. The apparatus of claim 3, wherein an upper end of the inwardly converging frustoconical element has an outer diameter dimensioned to be received in the opening of the chalk containment pouch.

5. The apparatus of claim 4, further comprising:

an annular rim defined about the top portion above the annular groove.

6. The apparatus of claim 5, wherein the annular groove is defined as a circular section, the annular groove dimensioned to receive a closure element surrounding the opening of the chalk containment pouch, the closure element operable between an open position and a partially closed position.

7. The apparatus of claim 6, wherein a cinching of the closure element retains the opening of the chalk containment pouch with the apparatus.

* * * * *